US008920293B1

(12) United States Patent
Rosaly

(10) Patent No.: US 8,920,293 B1
(45) Date of Patent: Dec. 30, 2014

(54) RESISTANCE EXERCISE DEVICE

(71) Applicant: Thomas Rosaly, Bronx, NY (US)

(72) Inventor: Thomas Rosaly, Bronx, NY (US)

( * ) Notice: Subject to any disclaimer, the term of this patent is extended or adjusted under 35 U.S.C. 154(b) by 132 days.

(21) Appl. No.: 13/866,192

(22) Filed: Apr. 19, 2013

(51) Int. Cl.
*A63B 21/02* (2006.01)

(52) U.S. Cl.
CPC ..... *A63B 21/02* (2013.01)
USPC ..... 482/126; 482/121; 482/122

(58) Field of Classification Search
CPC ..... A63B 21/0004; A63B 21/00043; A63B 21/015; A63B 21/0552
USPC ..... 482/121–126, 129, 130, 141, 148, 907
See application file for complete search history.

(56) References Cited

U.S. PATENT DOCUMENTS

| | | | | |
|---|---|---|---|---|
| 5,556,369 | A | 9/1996 | Roberts | |
| 6,450,929 | B1 | 9/2002 | Markham | |
| 7,785,243 | B2 | 8/2010 | Kassel | |
| 2014/0051558 | A1 * | 2/2014 | Flentye et al. | 482/139 |

* cited by examiner

*Primary Examiner* — Loan H Thanh
*Assistant Examiner* — Nyca T Nguyen
(74) *Attorney, Agent, or Firm* — Crossley Patent Law

(57) ABSTRACT

A resistance exercise device for exercising the arms and upper core of the body. The device includes a pair of handle assemblies connected together with a replaceable elastomeric resistance member to permit the use of a resistance member having a desired length and resistance strength. Each handle assembly includes a handle member and a convex support member attached thereto which are separable to permit replacement of a non-slip hollow cylindrical hand grip that engages a center portion of the handle member.

5 Claims, 3 Drawing Sheets

RESISTANCE EXERCISE DEVICE

BACKGROUND OF THE INVENTION

Various types of exercise devices are known in the prior art. However, what is needed is a resistance exercise device to exercise the arms and upper core of the body. The device includes a pair of handle assemblies connected together with a replaceable elastomeric resistance member to permit the use of a resistance member having a desired length and resistance strength. Each handle assembly includes a handle member and a convex support member attached thereto which are separable to permit replacement of a non-slip hollow cylindrical hand grip that engages a center portion of the handle member.

FIELD OF THE INVENTION

The present invention relates to exercise devices, and more particularly, to a resistance exercise device.

SUMMARY OF THE INVENTION

The general purpose of the present resistance exercise device, described subsequently in greater detail, is to provide a resistance exercise device which has many novel features that result in a resistance exercise device which is not anticipated, rendered obvious, suggested, or even implied by prior art, either alone or in combination thereof.

To accomplish this, the present resistance exercise device is designed to exercise the arms and upper core of the body by allowing a user to simulate sparring and boxing movements is illustrated. The resistance exercise device generally includes a pair of identical handle assemblies attached together in a mirror image configuration by an elastomeric resistance member that provides resistance to stretching depending upon the length and thickness of the resistance member. Each handle assembly includes a substantially U-shaped handle member having an upper side with generally D-shaped top end, a lower side with a generally D-shaped bottom end, and a center portion disposed therebetween. Each of the D-shaped top end and the bottom end form an opening. A non-slip hollow cylindrical hand grip engages the entire center portion.

A convex support member is attached to the handle member. The support member has an upper end, a lower end, and a central body disposed therebetween. An orifice between the support member and the handle member is configured to receive a user's digits therethrough in a flexed position to grip the hand grip. A continuous reinforced channel is disposed from each of the upper end and the lower end through the central body proximal the upper end and the lower end. A locking pin, which is removably disposed across the channel at each of the upper end and the lower end, engages a respective one of the openings in the top end and the bottom end to removably secure the handle member to the support member. Thus, the hand grip may be replaced by separating the handle member from the support member.

An aperture is disposed through the central body along a central horizontal axis thereof. The resistance member passes through each of the apertures and has diametrically opposed outer ends that secure the resistance member to the central body of the support member. The outer ends are knotted to secure the resistance member to the central body.

A cap removably engages the central body to cover the outer ends of the resistance member. The cap and the outer ends are configured for removal from each support member central body to secure the outer ends to the central body and to protect the outer ends from fraying, while also permitting a user to replace the resistance member. Thus, the resistance member can be interchanged to provide a wide range of lengths and diameters, which correspond to varying resistance strengths. The resistance member can, therefore, accommodate a wide variety of exercises, some of which focus on movements that involve short distances between the arms including sparring and boxing movements, such as jabs, punches, and undercuts, as well as movements that involve extended stretching of the arms as are used in other sports, such as karate. The resistance member is an elastomeric cord, which can be braided, as illustrated.

The outer ends of the resistance member may alternately be permanently attached to the central body. In another embodiment, the outer ends may include clips disposed thereon, rather than knots, that attach to a bar disposed on an inner side of the cap thereby securing the resistance member to the central body.

Each handle member has a width in a range of 1 inch to 2 inches. The central portion of the handle member has a length in a range of 4 to 6 inches. The support member has a maximum height in a range of 4 to 6 inches and a width in a range of 1½ inches to 2½ inches.

Thus has been broadly outlined the more important features of the present resistance exercise device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
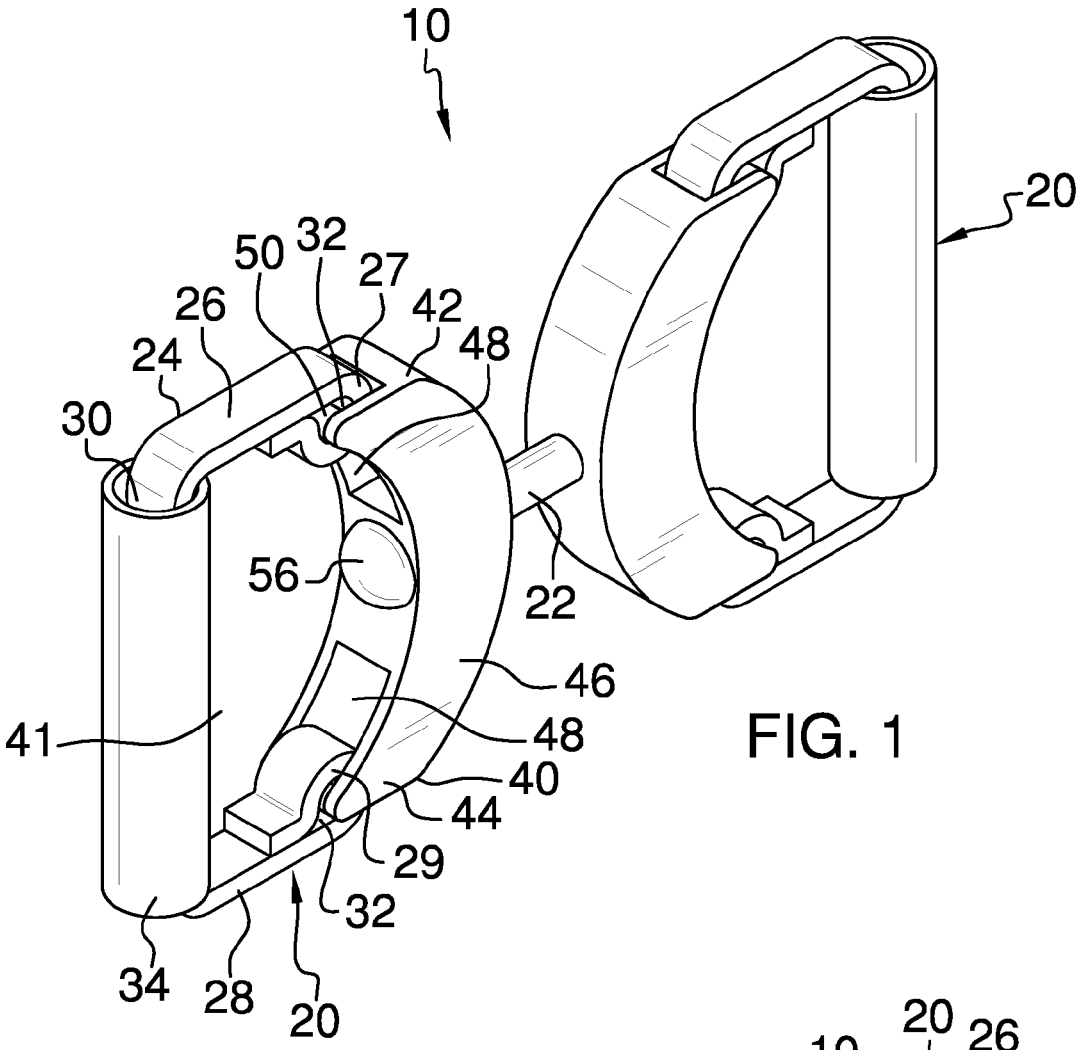
FIG. 1 is an isometric view.
Figure 2:
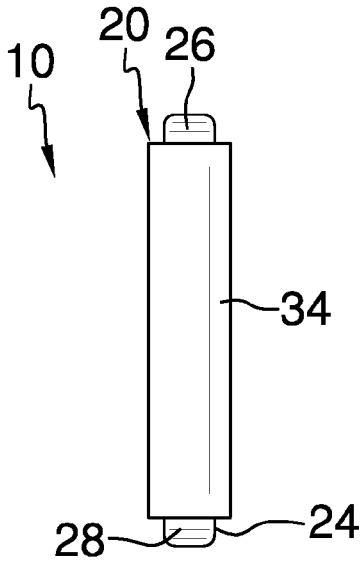
FIG. 2 is a side elevation view.
Figure 3:
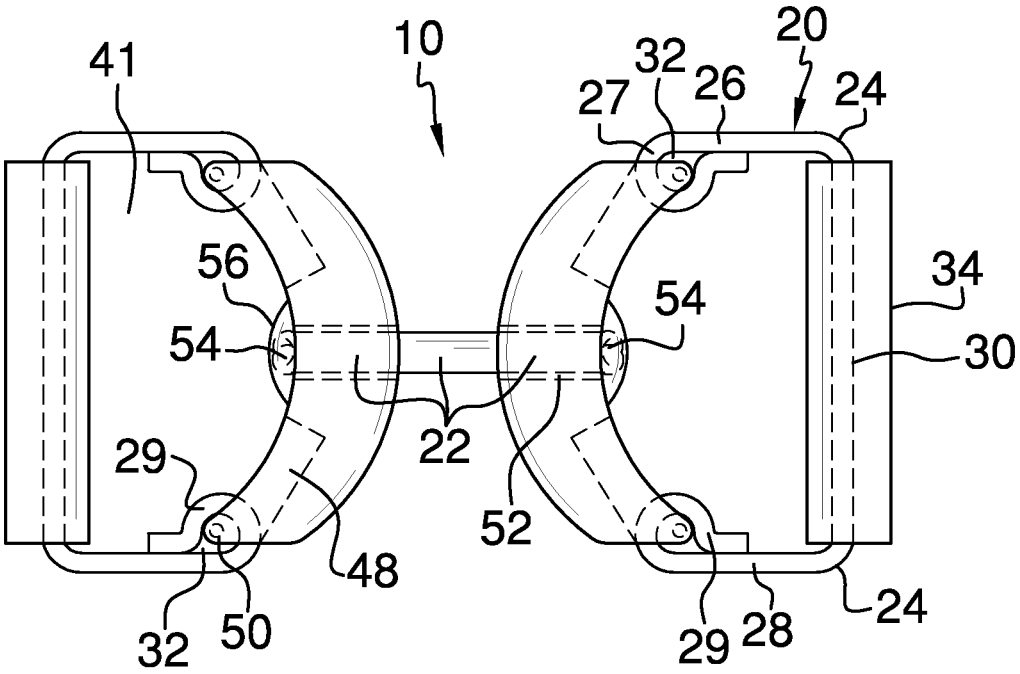
FIG. 3 is a front elevation view.
Figure 4:
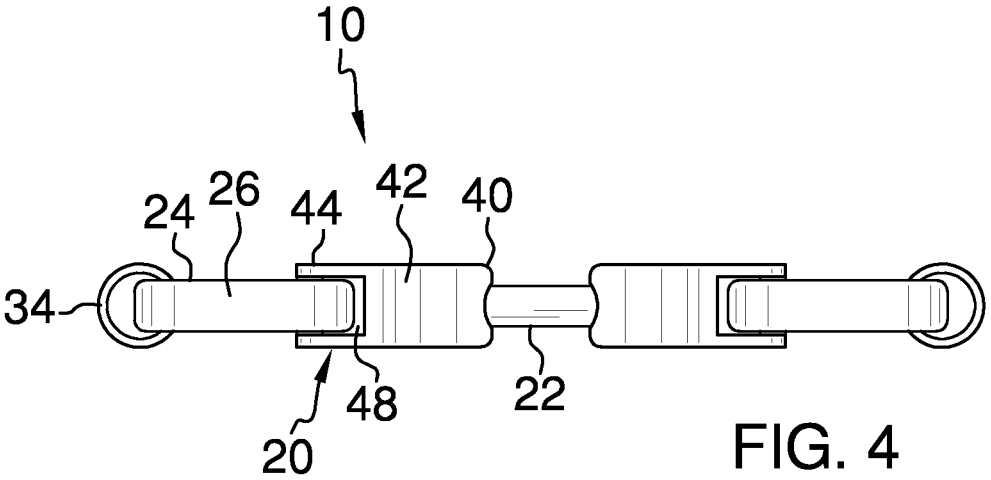
FIG. 4 is a top plan view.
Figure 5:
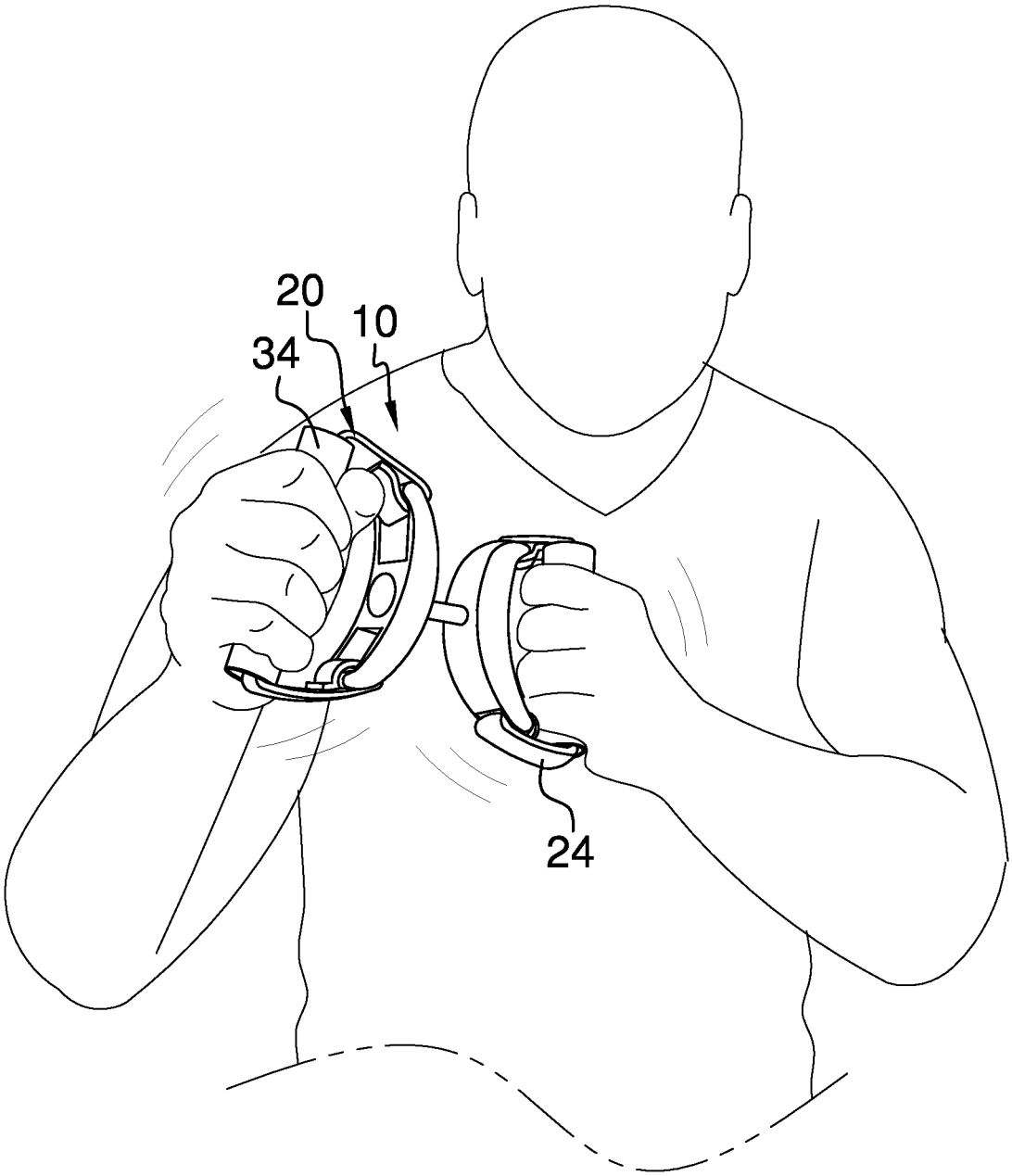
FIG. 5 is an in-use view.

With reference now to the drawings, and in particular FIGS. 1 through 5 thereof, the instant resistance exercise device employing the principles and concepts of the present resistance exercise device and generally designated by the reference number 10 will be described.

Referring to FIGS. 1 through 5 the present resistance exercise device 10 designed to exercise the arms and upper core of the body by simulating sparring and boxing movements is illustrated. The resistance exercise device 10 generally includes a pair of identical handle assemblies 20 attached together in a mirror image configuration by an elastomeric resistance member 22 that provides resistance to stretching depending upon the length and thickness of the resistance member 22. Each handle assembly 20 includes a substantially U-shaped handle member 24. The handle member 24 has an upper side 26 with generally D-shaped top end 27, a lower side 28 with a generally D-shaped bottom end 29, and a center portion 30 disposed therebetween. Each of the D-shaped top end 27 and the bottom end 29 form an opening 32. A non-slip hollow cylindrical hand grip 34 engages the entire center portion 30.

A convex support member 40 is attached to the handle member 24. An orifice 41 between the support member 40 and the handle member 24 is configured to receive a user's digits therethrough in a flexed position to grip the hand grip 34. The support member 40 has an upper end 42, a lower end 44, and a central body 46 disposed therebetween. A continuous channel 48 is disposed from each of the upper end 42 and the lower end 44 through the central body 46 proximal the upper end 42 and the lower end 44. Each channel 48 is reinforced. A locking pin 50 is removably disposed across the channel 48 at each of the upper end 42 and the lower end 44 Each locking pin 50 engages a respective one of the openings 32 in the top end 27 and the bottom end 29 to removably secure the handle member 24 to the support member 40. Thus, the hand grip 34 may be replaced by separating the handle member 24 from the support member 40.

An aperture 52 is disposed through the central body 46 along a central horizontal axis thereof. The resistance member 22 continuously engages the aperture 52. The resistance member 22 has diametrically opposed knotted outer ends 54 that secure the resistance member 22 to the central body 46 of the support member 40. A cap 56 removably engages the central body 46 to cover the outer ends 54 of the resistance member 22. The cap 56 and the outer ends 54 are configured for removal from each support member 40 central body 46 to secure the outer ends 54 to the central body 46 and to prevent the outer ends 54 from fraying, while also permitting a user to replace the resistance member 22. Thus, the resistance member 22 can be interchanged to provide a wide range of lengths and diameters, which correspond to varying resistance strengths. The resistance member 22 can, therefore, accommodate a wide variety of exercises including those that focus on movements involving short extensions of the arms including sparring and boxing movements, such as jabs, punches, and undercuts, as well as movements that focus on extended arm stretching as are used in other sports, such as karate. The resistance member 22 is an elastomeric cord, which can be braided, as illustrated.

Each handle member 24 has a width in a range of 1 inch to 2 inches. The central portion 30 of the handle member 24 has a length in a range of 4 to 6 inches. The support member 40 has a maximum height in a range of 4 to 6 inches and a width in a range of 1½ inches to 2½ inches.

What is claimed is:

1. A resistance exercise device comprising:

a pair of identical handle assemblies, each handle assembly comprising:

a substantially U-shaped handle member having an upper side with generally D-shaped top end, a lower side with a generally D-shaped bottom end, and a center portion disposed therebetween;

an opening formed at each of the top end and bottom end;

a convex support member attached to the handle member, the support member having an upper end, a lower end, and a central body disposed therebetween;

an orifice disposed between the support member and the handle member, the orifice being configured to receive a user's digits therethrough in a flexed position to grip a handle grip;

a continuous channel disposed from each of the upper end and the lower end to the central body proximal the upper end and the lower end;

a locking pin removably disposed across the channel at each of the upper end and the lower end, each locking pin engaging a respective one of the openings in the top end and the bottom end of the handle member, wherein the locking pin removably secures the handle member to the support member;

an aperture disposed through the central body along a central horizontal axis thereof; and an elastomeric resistance member attached between each of the handle assemblies, the resistance member having a pair of diametrically opposed outer ends, the aperture of the handle member of each handle assembly continuously receiving the respective outer end of the resistance member therethrough, wherein each outer end securingly attaches to the central body of the respective handle assembly, wherein the handle assemblies are disposed in a mirror image configuration upon attachment to the resistance member.

2. The resistance exercise device of claim 1 further comprising wherein said hand grip is a non-slip hollow cylindrical hand grip engaging the entire center portion.

3. A resistance exercise device comprising:

a pair of identical handle assemblies, each handle assembly comprising:

a substantially U-shaped handle member having an upper side with generally D-shaped top end, a lower side with a generally D-shaped bottom end, and a center portion disposed therebetween;

an opening formed at each of the top end and bottom end;

a non-slip hollow cylindrical hand grip engaging the entire center portion;

a convex support member attached to the handle member, the support member having an upper end, a lower end, and a central body disposed therebetween;

an orifice disposed between the support member and the handle member, the orifice being configured to receive a user's digits therethrough in a flexed position to grip the hand grip;

a continuous reinforced channel disposed from each of the upper end and the lower end to the central body proximal the upper end and the lower end;

a locking pin removably disposed across the channel at each of the upper end and the lower end, each locking pin engaging a respective one of the openings in the top end and the bottom end of the handle member, wherein the locking pin removably secures the handle member to the support member;

an aperture disposed through the central body along a central horizontal axis thereof; and an elastomeric resistance member attached between each of the handle assemblies, the resistance member engaging the aperture of the handle member of each handle assembly, the resistance member having diametrically opposed knotted outer ends securingly engaging the central body, wherein the handle assemblies are disposed in a mirror image configuration upon attachment to the resistance member.

4. The resistance exercise device of claim 2 further comprising a cap removably engaging the central body in a position covering the outer ends of the resistance member.

5. The resistance exercise device of claim 3 wherein each handle member has a width in a range of 1 inch to 2 inches;

wherein the central portion of the handle member has a length in a range of 4 to 6 inches; and wherein the support member has a maximum height in a range of 4 to 6 inches and a width in a range of 1½ inches to 2½ inches.

* * * * *